US008418266B1

(12) United States Patent
Pike

(10) Patent No.: US 8,418,266 B1
(45) Date of Patent: Apr. 16, 2013

(54) HAT OR CAP HAVING SYNTHETIC HAIR EXTENDING THERETHROUGH OR SECURED THERETO

(76) Inventor: Patricia Pike, Lake Wales, FL (US)

( * ) Notice: Subject to any disclaimer, the term of this patent is extended or adjusted under 35 U.S.C. 154(b) by 206 days.

(21) Appl. No.: 12/827,766

(22) Filed: Jun. 30, 2010

(51) Int. Cl.
*A42B 1/24* (2006.01)

(52) U.S. Cl.
USPC ..... 2/209.13; 2/195.1

(58) Field of Classification Search ..... 2/171, 171.1, 2/171.2, 209.13, 209.14, 209.3, 209.7, 175.1, 2/175.3, 195.1, 195.2, 195.7, 195.8, 200.1, 2/202, 204, 205, 207, 174, 181, 184.5; 132/201, 132/105, 53, 54; D2/872, 895, 869, 866, D2/865, 870, 873, 882
See application file for complete search history.

(56) References Cited

U.S. PATENT DOCUMENTS

D124,074 S * 12/1940 Greenberg et al. ..... D2/890
2,264,594 A * 12/1941 Schuessler ..... 2/172
D162,965 S * 4/1951 Krieger ..... D2/872
3,550,161 A * 12/1970 Orozco ..... 2/172
D244,236 S * 5/1977 Kyle ..... D29/122
5,170,509 A * 12/1992 Leopold ..... 2/195.1
5,493,735 A * 2/1996 Rice ..... 2/209.13
5,511,249 A * 4/1996 Higgins ..... 2/209.7
5,799,334 A * 9/1998 Griffith et al. ..... 2/195.1
5,933,872 A * 8/1999 Lema ..... 2/209.7
D420,207 S * 2/2000 Barton et al. ..... D2/889
D422,777 S * 4/2000 Scott ..... D2/869
D424,282 S * 5/2000 Crumpton et al. ..... D2/876
D442,746 S * 5/2001 Belcher ..... D29/122
D458,734 S * 6/2002 Clair ..... D2/869
D485,946 S * 1/2004 Angrum ..... D28/92
D501,280 S * 1/2005 Kole ..... D29/122
D501,281 S * 1/2005 Kole ..... D29/122
D501,957 S * 2/2005 Jagger ..... D29/122
7,047,571 B1 * 5/2006 Kelly ..... 2/209.13
D589,688 S * 4/2009 Turner ..... D2/891
D592,832 S * 5/2009 Radell ..... D2/866
D669,224 S * 10/2012 Morris ..... D28/92
2005/0108809 A1 * 5/2005 Kronenberger ..... 2/195.1
2006/0191057 A1 * 8/2006 Lynn ..... 2/171

FOREIGN PATENT DOCUMENTS

WO WO 2009/133205 * 11/2009

* cited by examiner

*Primary Examiner* — Amy Vanatta
(74) *Attorney, Agent, or Firm* — Daniel S. Polley, P.A.

(57) ABSTRACT

A hat having one or more portions of synthetic hair extending therethrough and/or secured to the hat to give the appearance of a person wearing a hat and having his or her real hair visibly showing. The hat can be a baseball style cap, Preferably, the synthetic hair can appear as a ponytail or one or more pig tails. The hat is ideal for persons who have experienced permanent or temporary hair loss.

18 Claims, 18 Drawing Sheets

HAT OR CAP HAVING SYNTHETIC HAIR EXTENDING THERETHROUGH OR SECURED THERETO

1. FIELD OF THE INVENTION

The present relates generally to the field of wearing apparel and particularly to fashion hats and caps having one or more synthetic hair portions extending through a portion of and/or secured to the hat.

2. BACKGROUND OF THE INVENTION

The loss of human hair for a person is common and can occur for various reasons, such as, but not limited to balding over time, medical illness, medical treatment, etc. The use of wigs and other device to disguise the baldness are well known. The present invention provides an advancement concerning the use of the hats as a device or means for hiding a person's baldness and provides a novel approach for securing synthetic hair to a hat, with the synthetic hair appearing to be real hair of the person wearing the hat.

SUMMARY OF THE INVENTION

The present invention provides a hat or cap (collectively referred to as "hat") having one or more portions of synthetic hair extending through and/or secured to the hat to give the appearance of a person wearing a hat and having his or her real hair visibly showing. Each hair portion contains many strands of synthetic hair in order to create a preferred "full" or "thick" hair appearance. Though not considered limiting, the hat is preferably a baseball cap, Preferably, the synthetic hair can appear as a ponytail or one or more pig tails, though such is not considered limiting, and other hair styles can be used and protrude out from the baseball cap. The hat is ideal for persons who have experienced permanent or temporary hair loss. However, the invention is not considered limited to such persons, and the hat of the present invention can also be worn by individuals who have a full head of hair.

DETAILED DESCRIPTION OF THE PREFERRED EMBODIMENT

Figure 1:
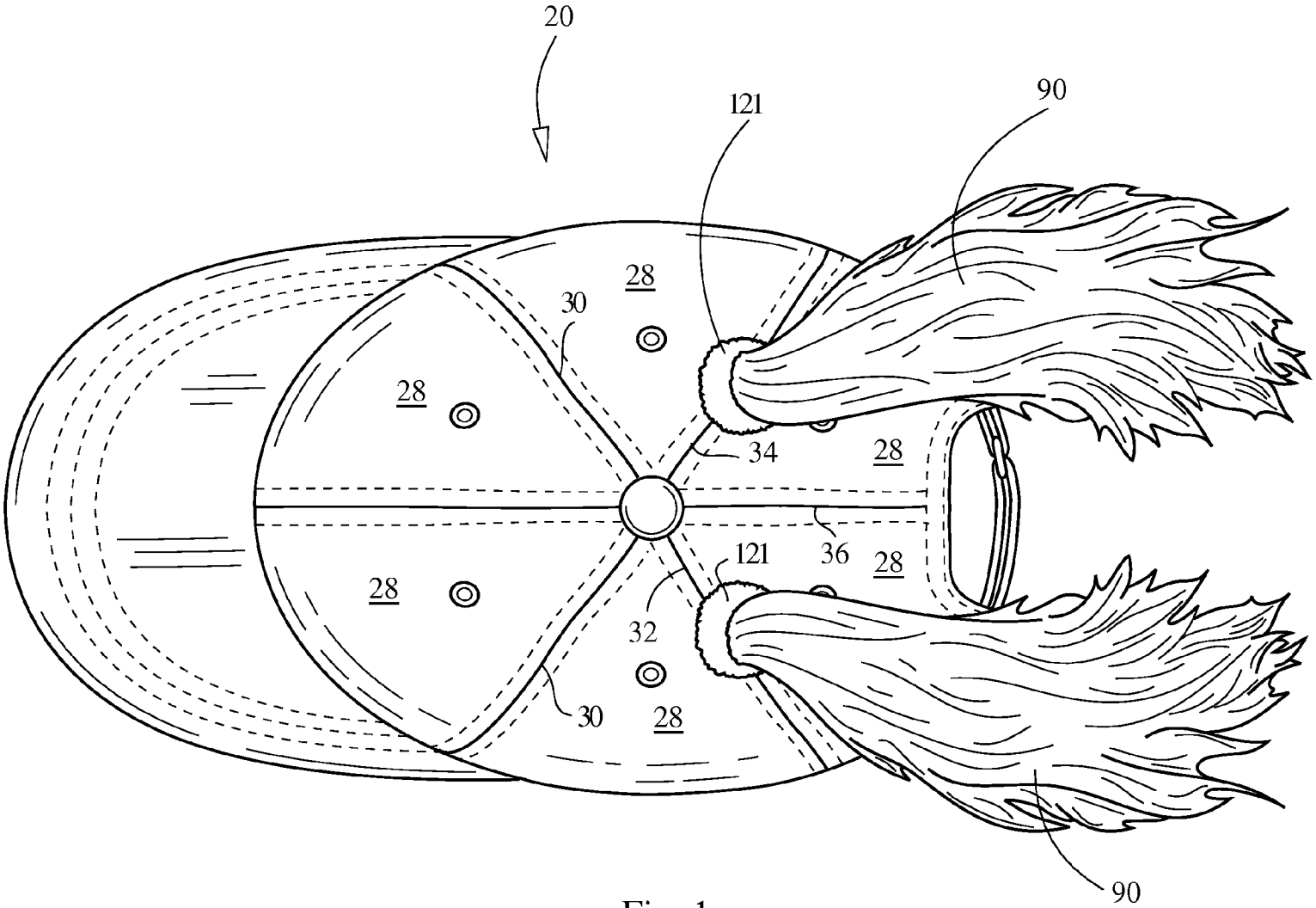
FIG. 1 is a top view of a first embodiment for the present invention hat having two synthetic hair portions extending through and/or secured to the hat in accordance with the present invention.
Figure 2:
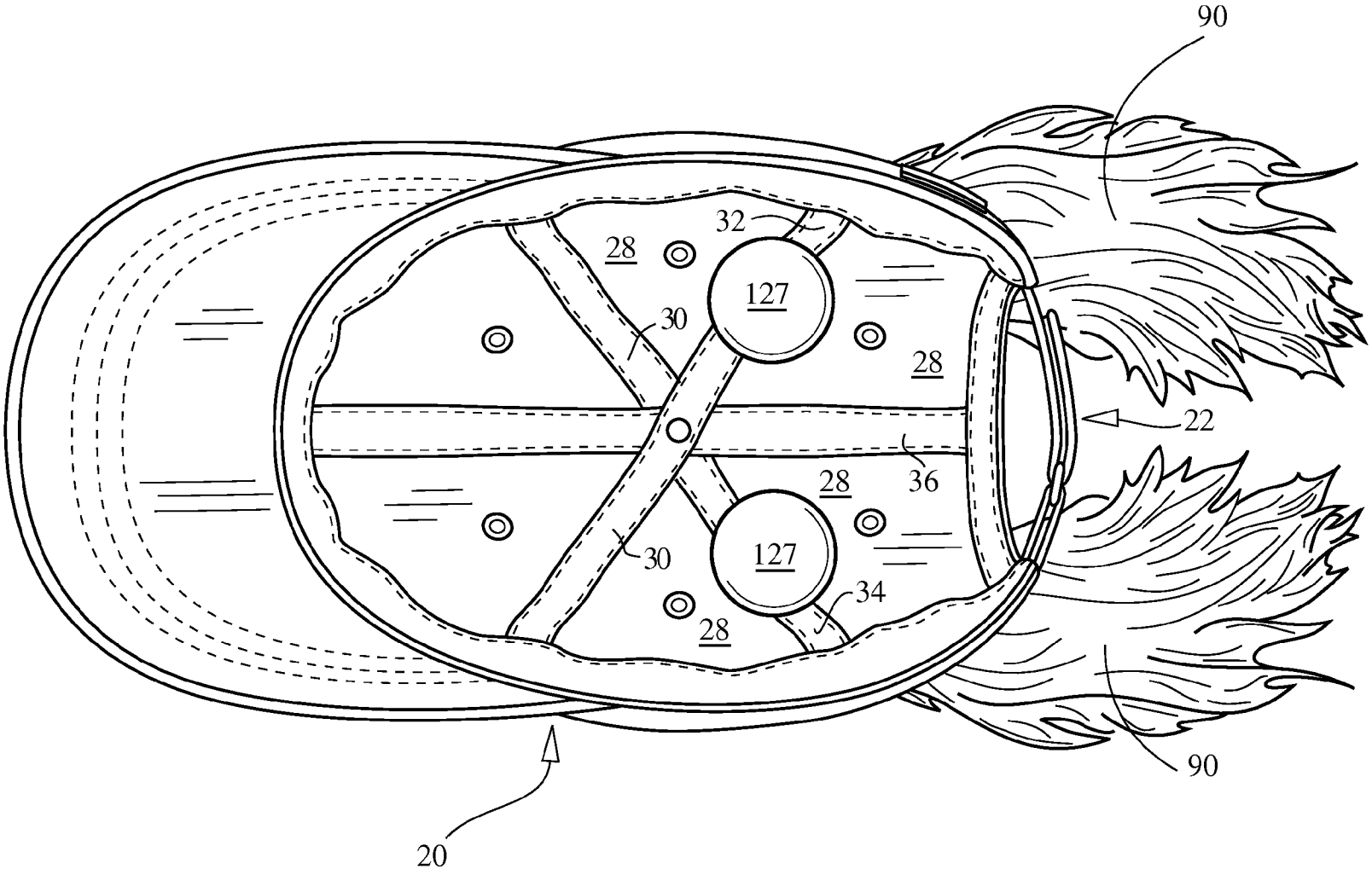
FIG. 2 is a bottom view of the hat of FIG. 1.
Figure 3:
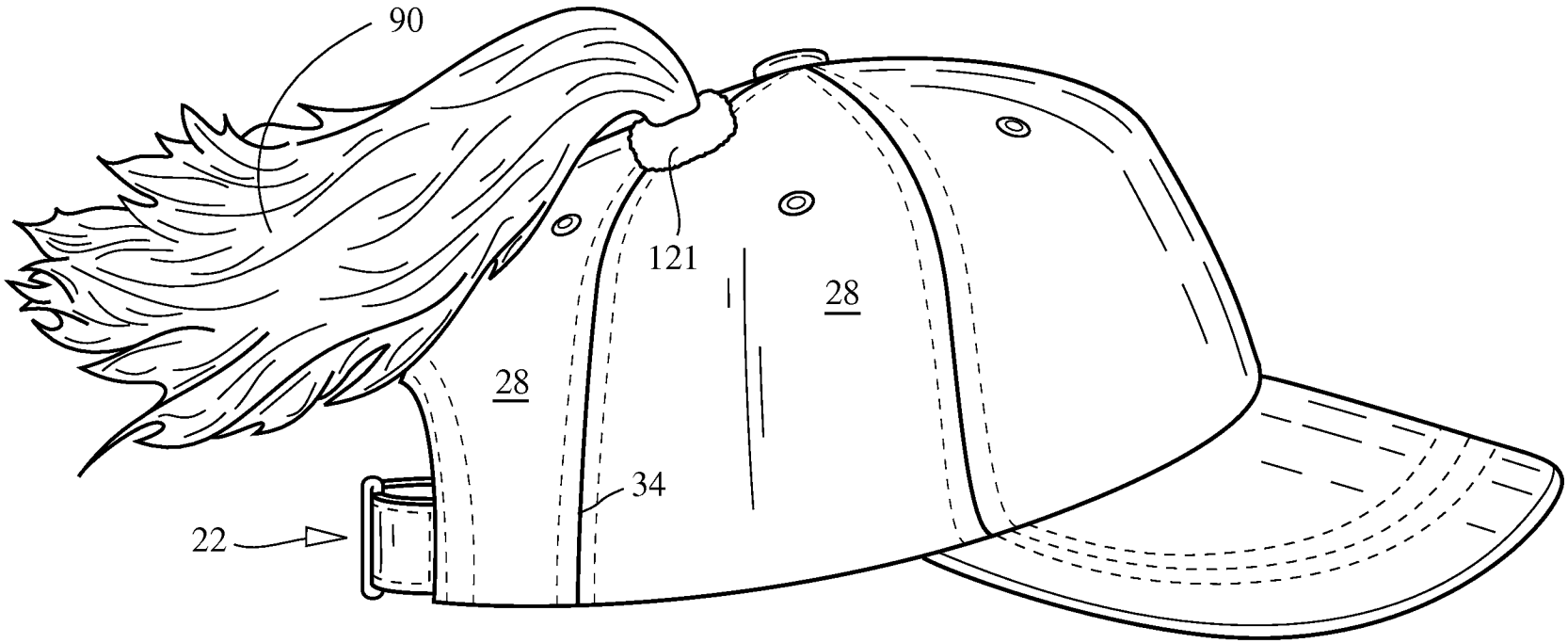
FIG. 3 is a right side view of the hat of FIG. 1.
Figure 4:
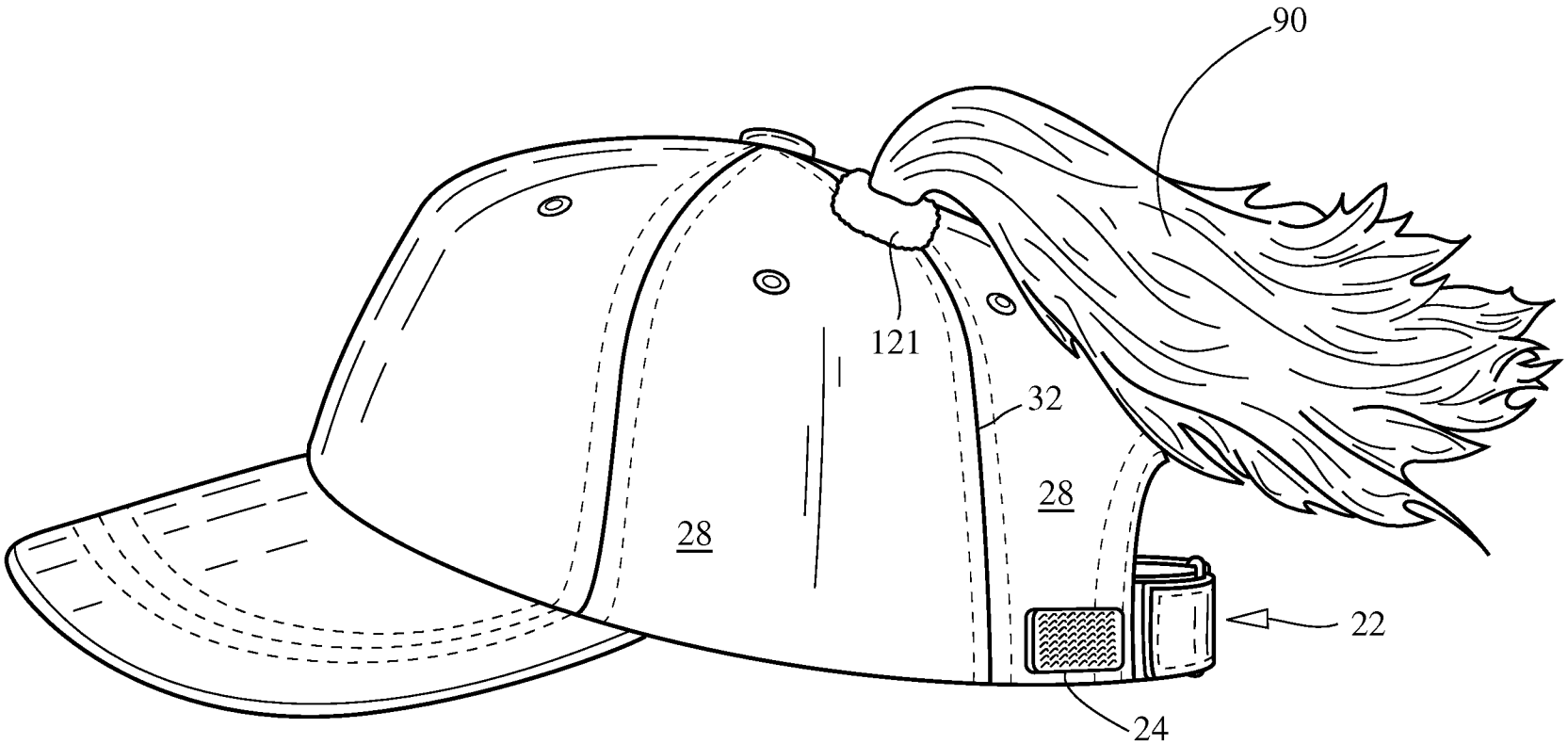
FIG. 4 is a left side view of the hat of FIG. 1.
Figure 5:
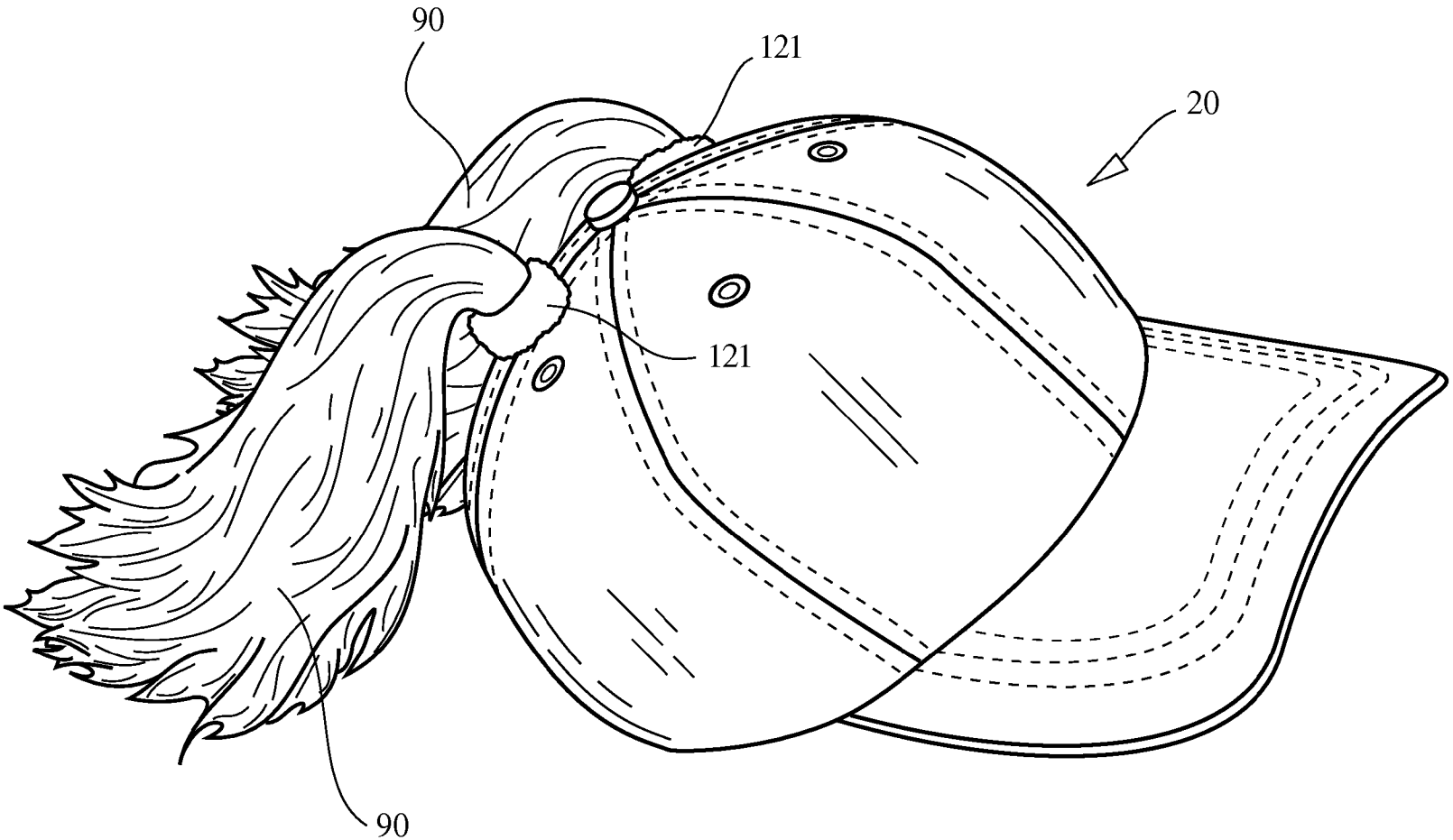
FIG. 5 is a front perspective view of the hat of FIG. 1.

As seen in the drawings a hat or cap to be worn on a person's head is illustrated in accordance with the present invention and generally designated as hat or cap 20 (collectively referred to as hat 20 herein out and for purposes of the patent claims). Hat 20 can be a baseball cap style, but such is not considered limiting and the present invention can also be used with other types of hat types and all are considered within the scope of the invention. Hat 20 is provided with one or more portions of synthetic hair preferably shown as pigtails 90 (FIGS. 1-7) or ponytail 100 (FIGS. 8-12). Each portion of synthetic hair comprises many individual strands of synthetic hair held together and which together create the appearance of a thick head of hair for the wearer of hat 20.

However, it should be recognized that the synthetic hair does not have to be in ponytail 100 or pigtails 90 form and other styles (i.e. freely hanging hair, etc.) that can be extend through and/or be secured to hat 20 can be used and are considered within the scope of the invention. Preferably, the synthetic hair is constructed with a bendable wire included in the hair product. The length of the synthetic hair portion and strands of hair comprising the synthetic hair portion are not limited to any specific length.

Figure 6:
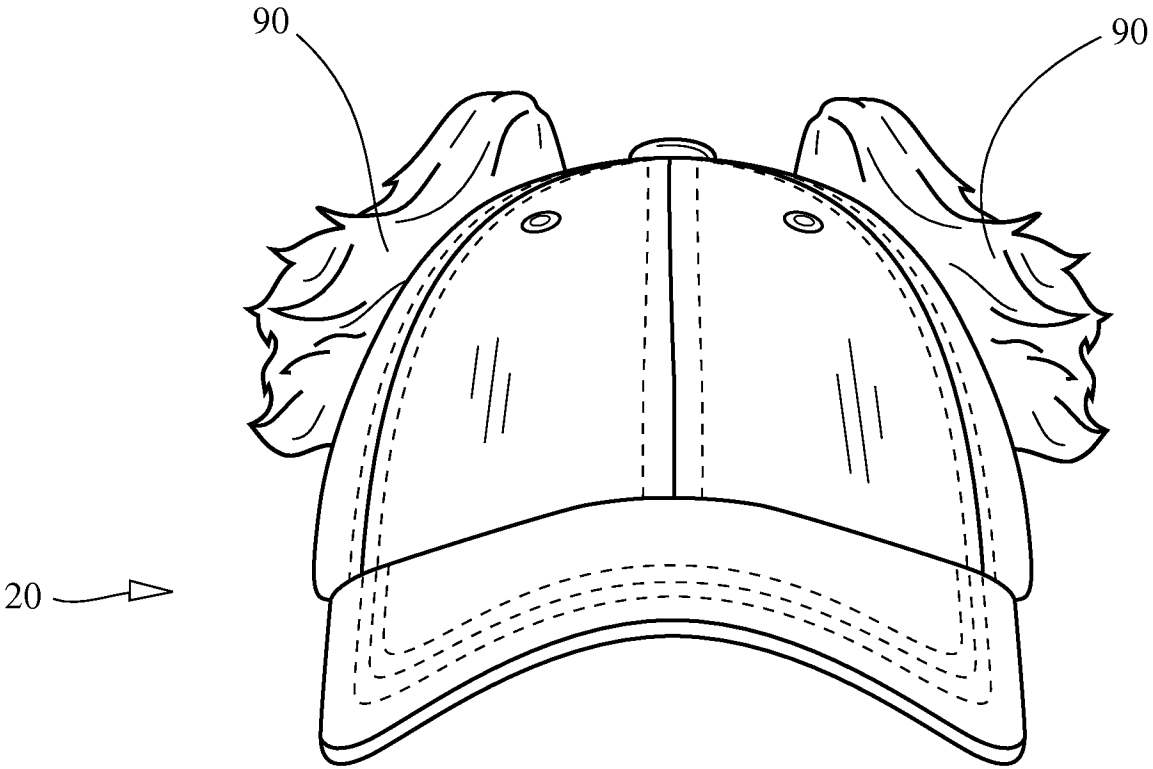
FIG. 6 is a front view of the hat of FIG. 1.
Figure 7:
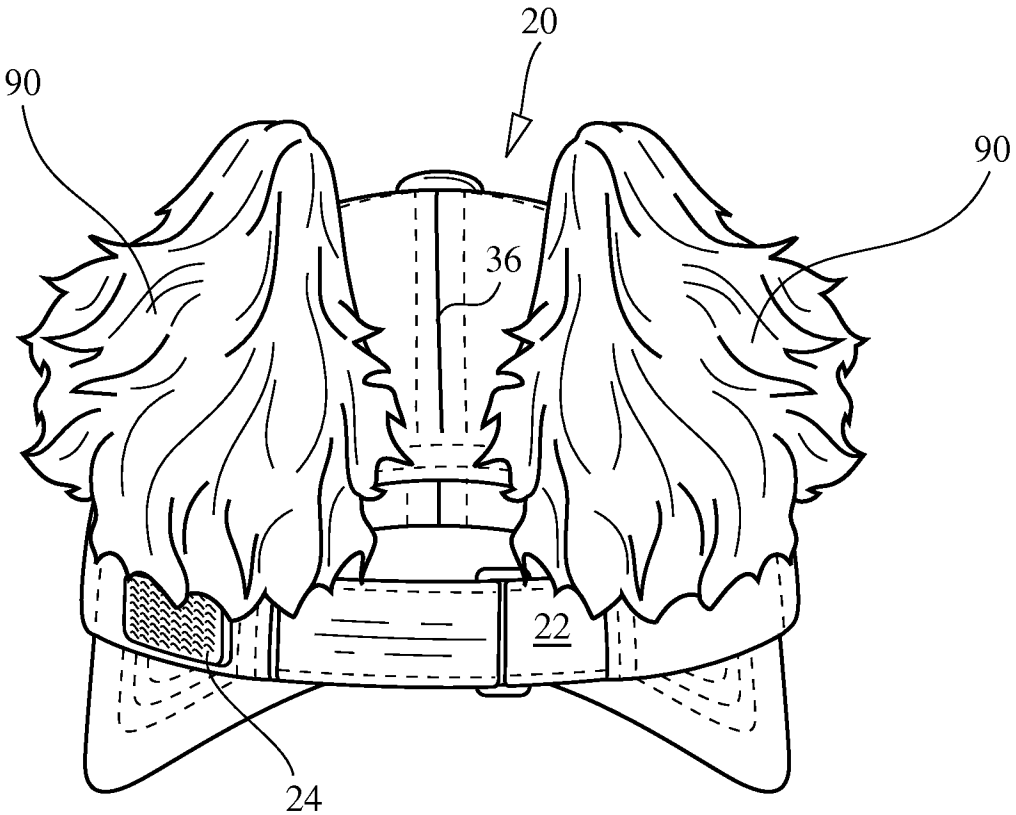
FIG. 7 is a back view of the hat of FIG. 1.
Figure 8:
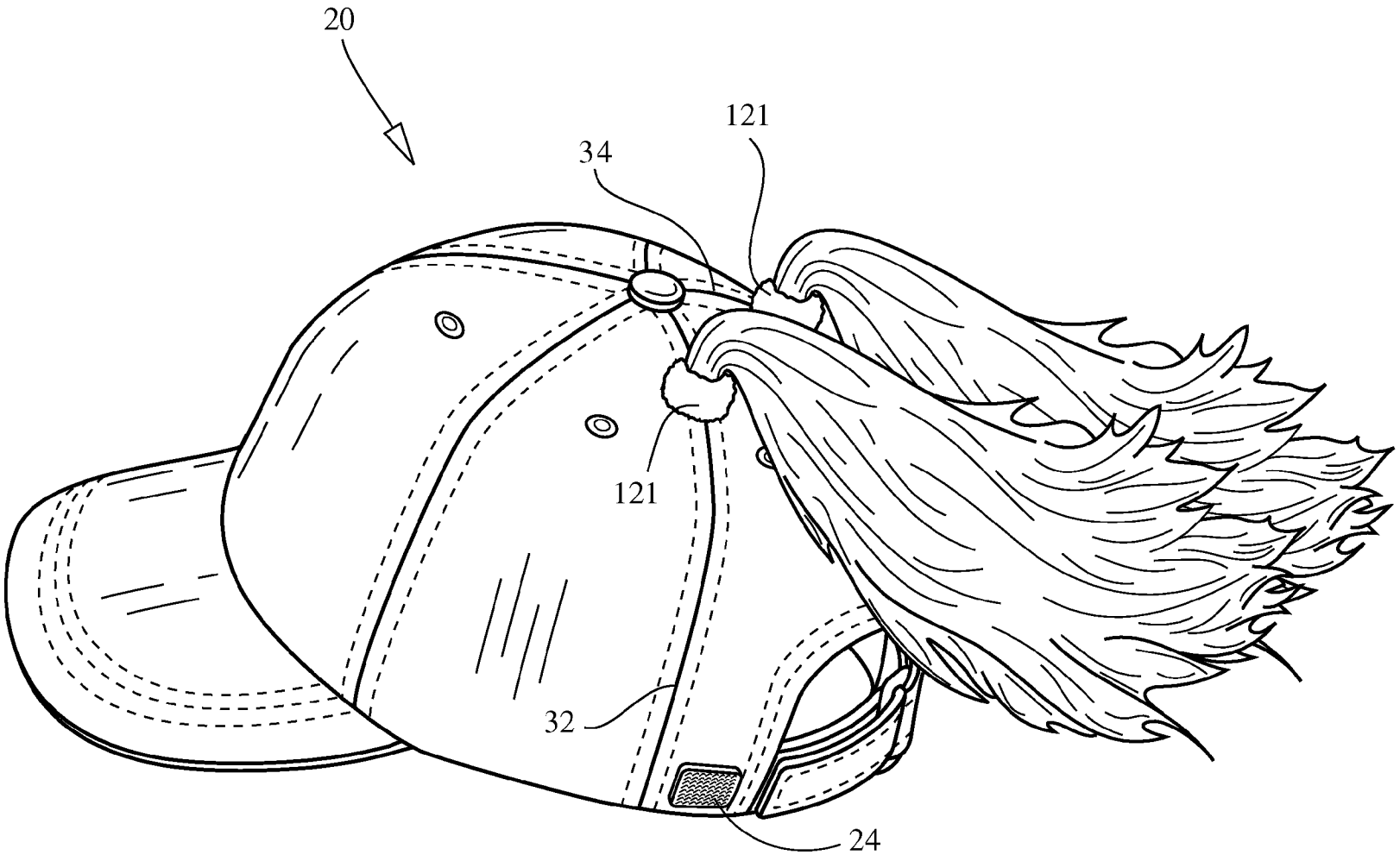
FIG. 8 is a back perspective view of the hat of FIG. 1.
Figure 9:
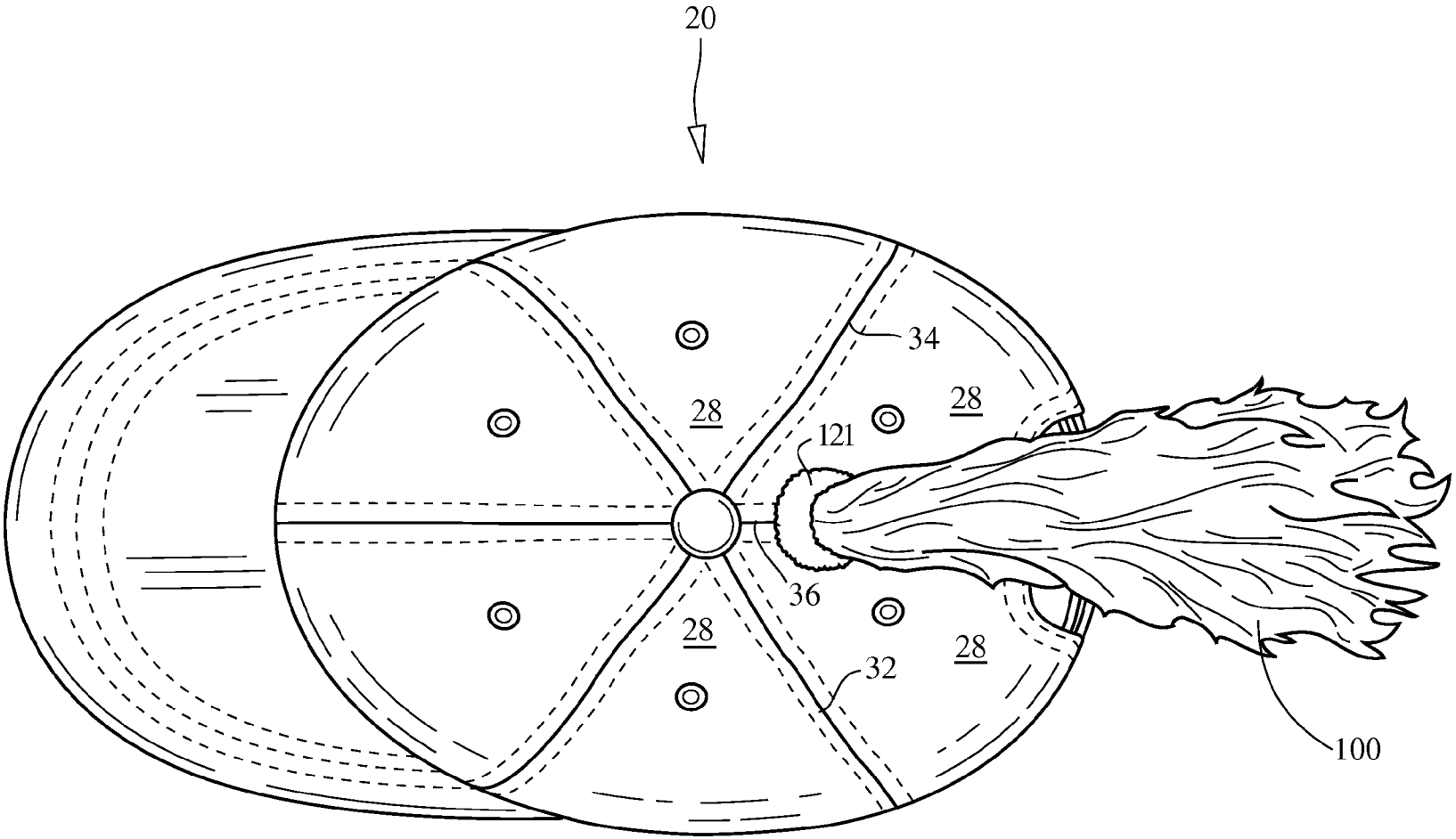
FIG. 9 is a top view of a second embodiment for the present invention hat having one synthetic hair portion extending through and/or secured to the hat in accordance with the present invention.
Figure 10:
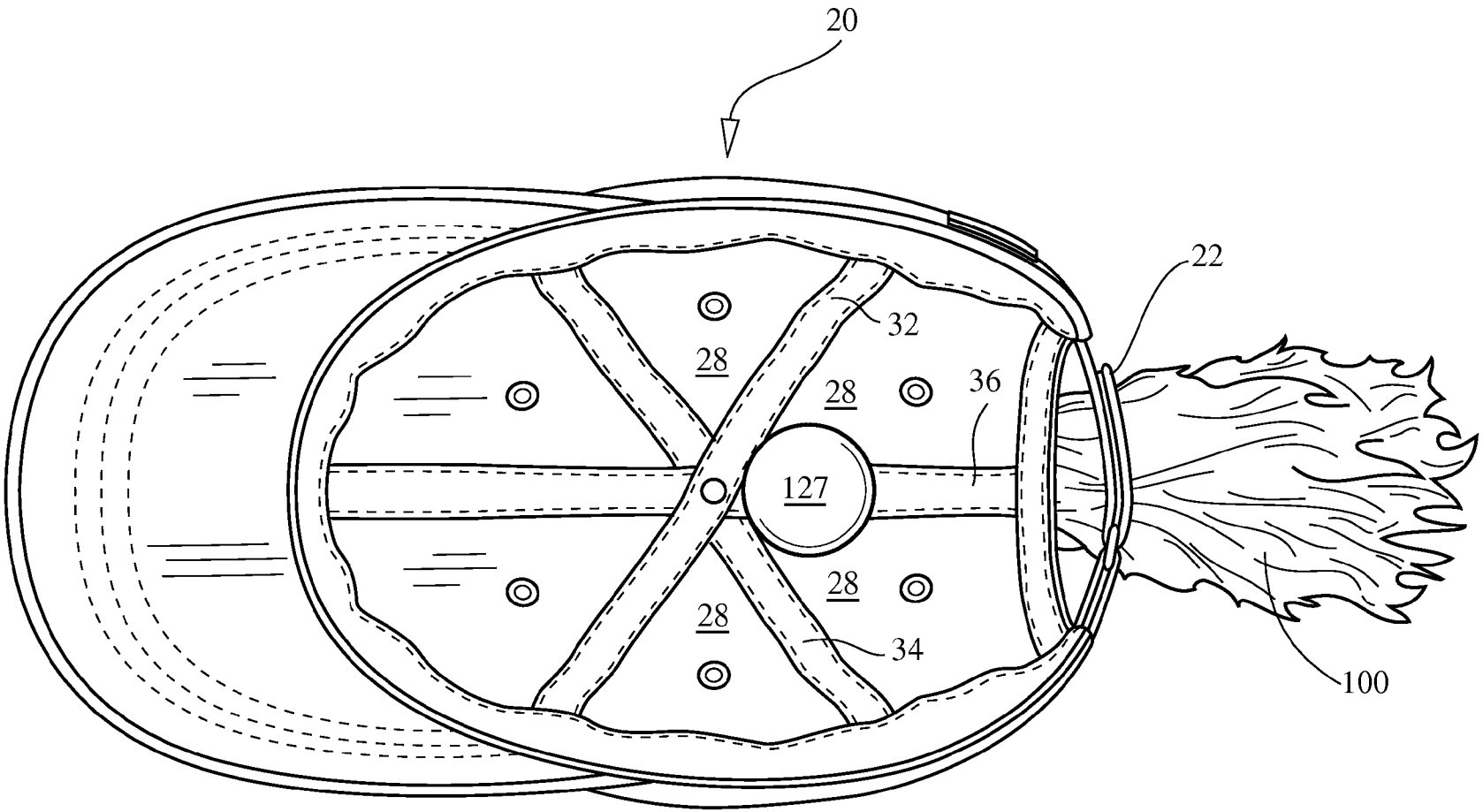
FIG. 10 is a bottom view of the hat of FIG. 9.
Figure 11:
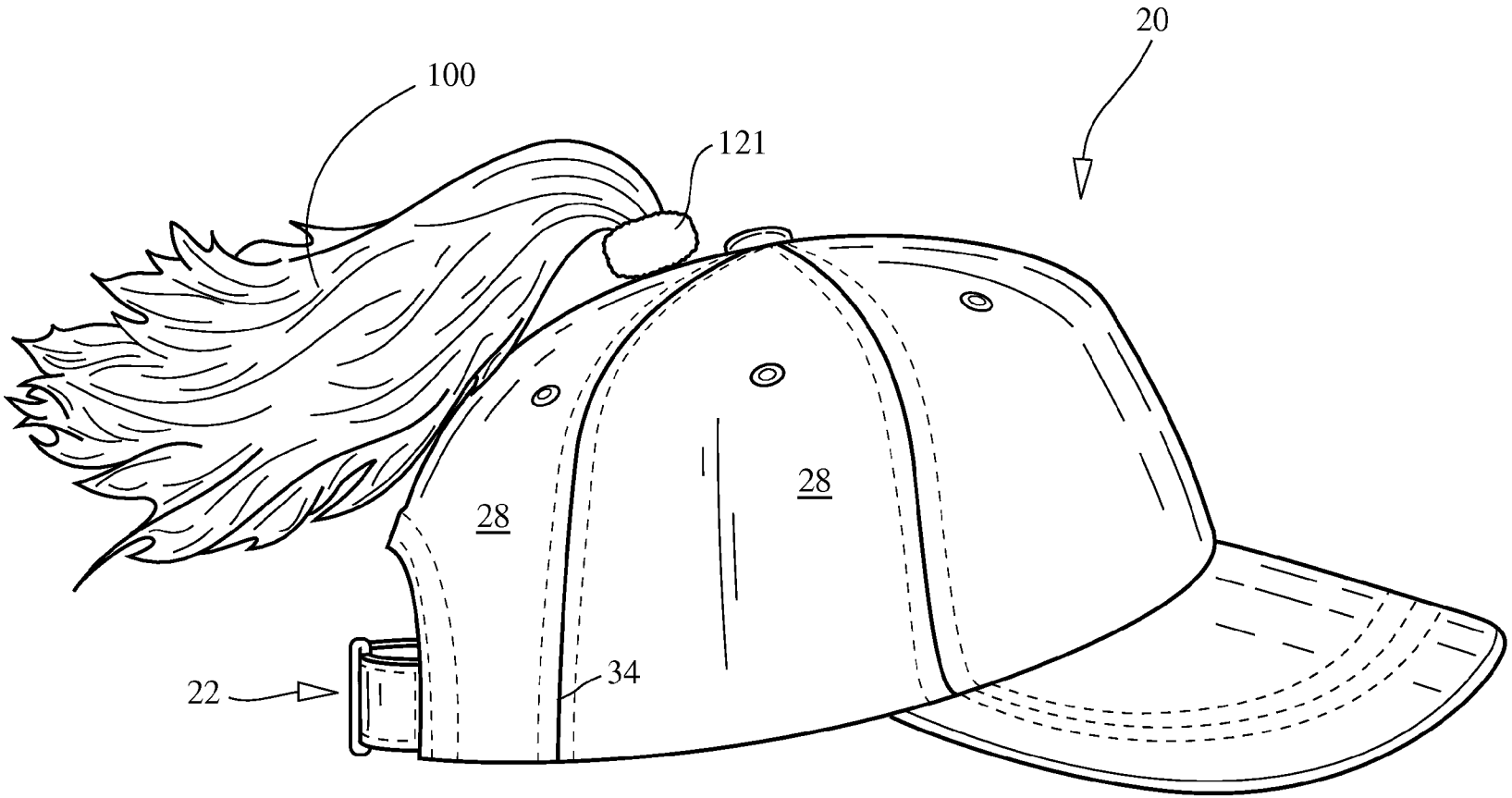
FIG. 11 is a right side view of the hat of FIG. 9.
Figure 12:
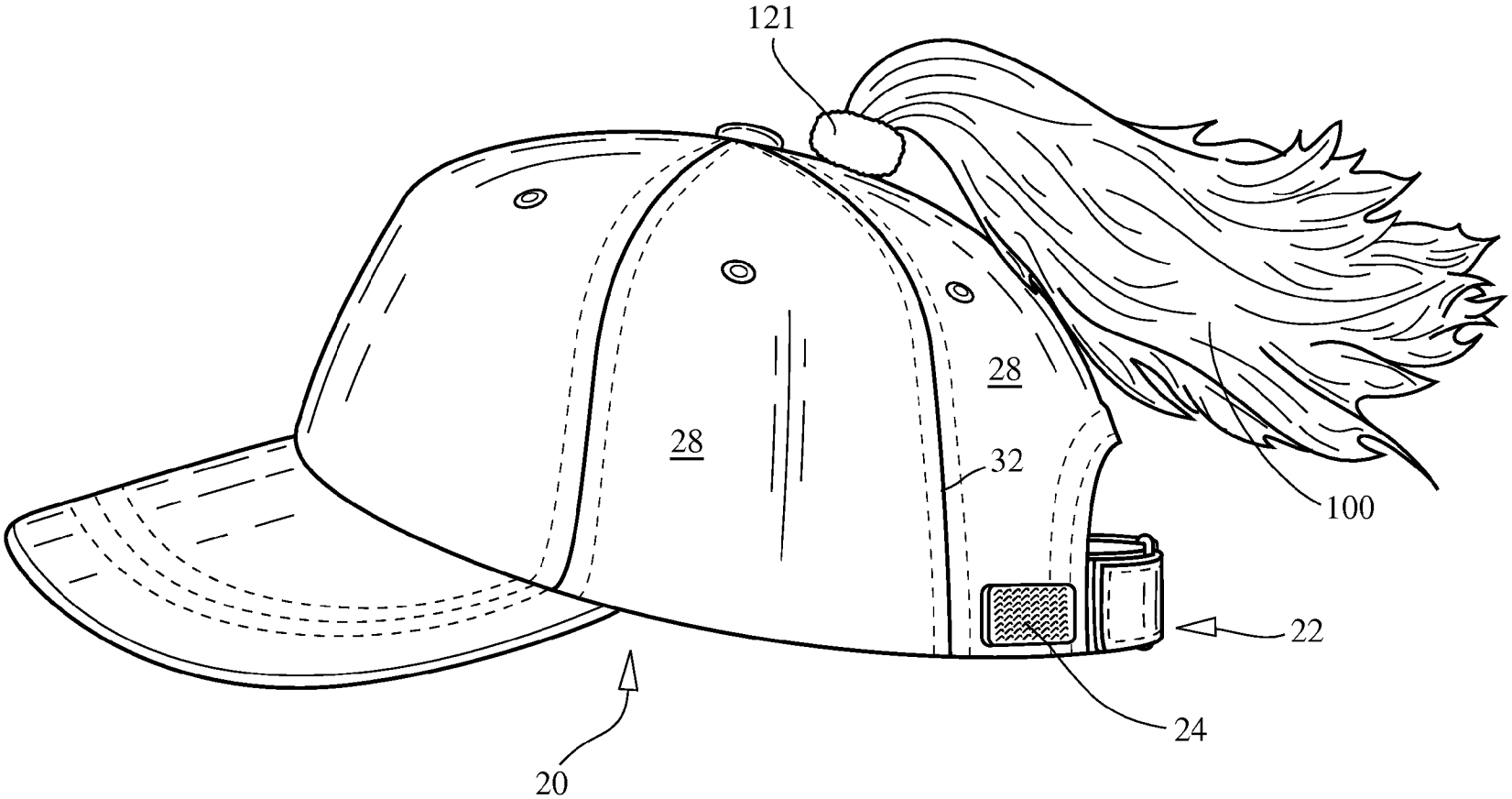
FIG. 12 is a left side view of the hat of FIG. 9.
Figure 13:
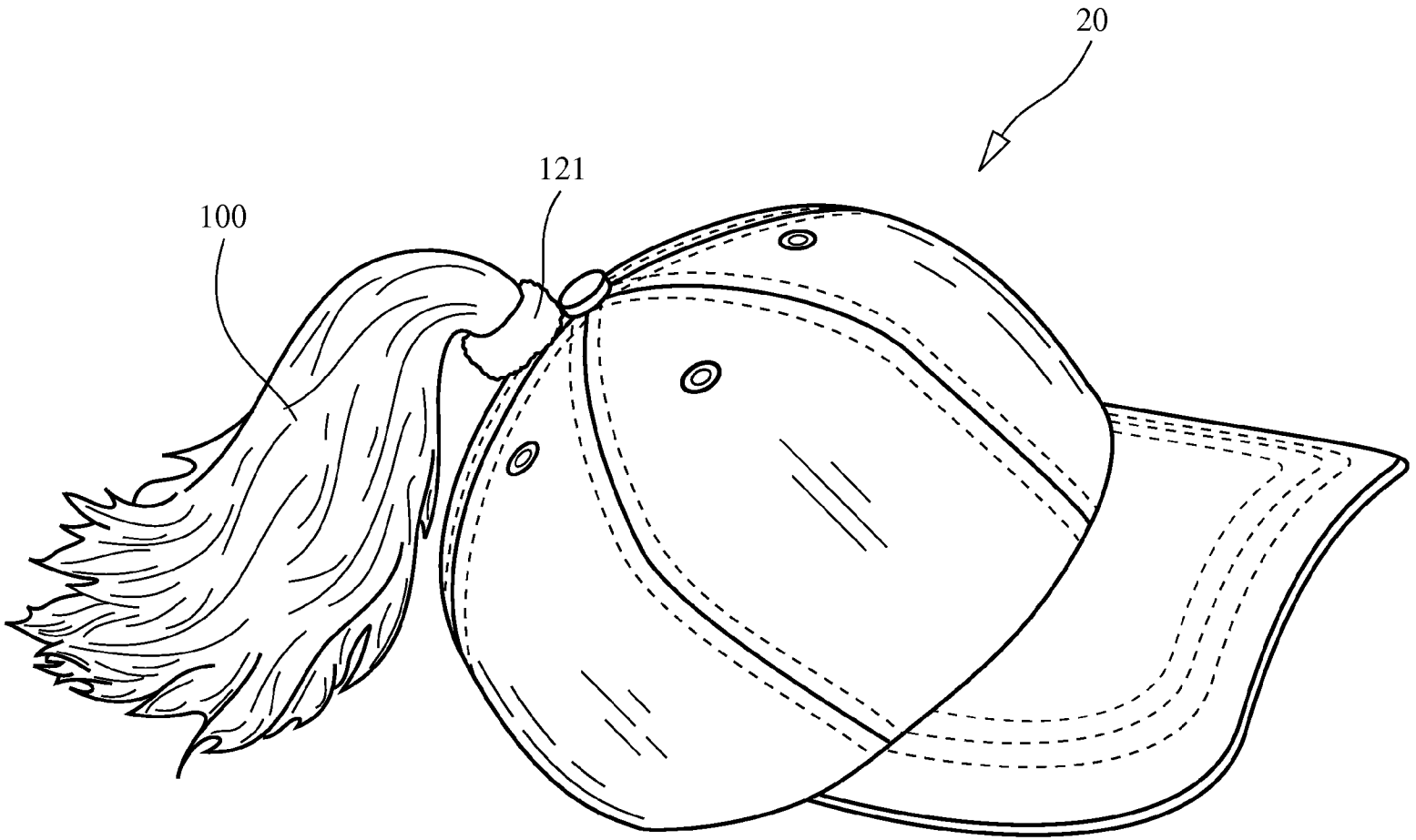
FIG. 13 is a front perspective view of the hat of FIG. 9.
Figure 14:
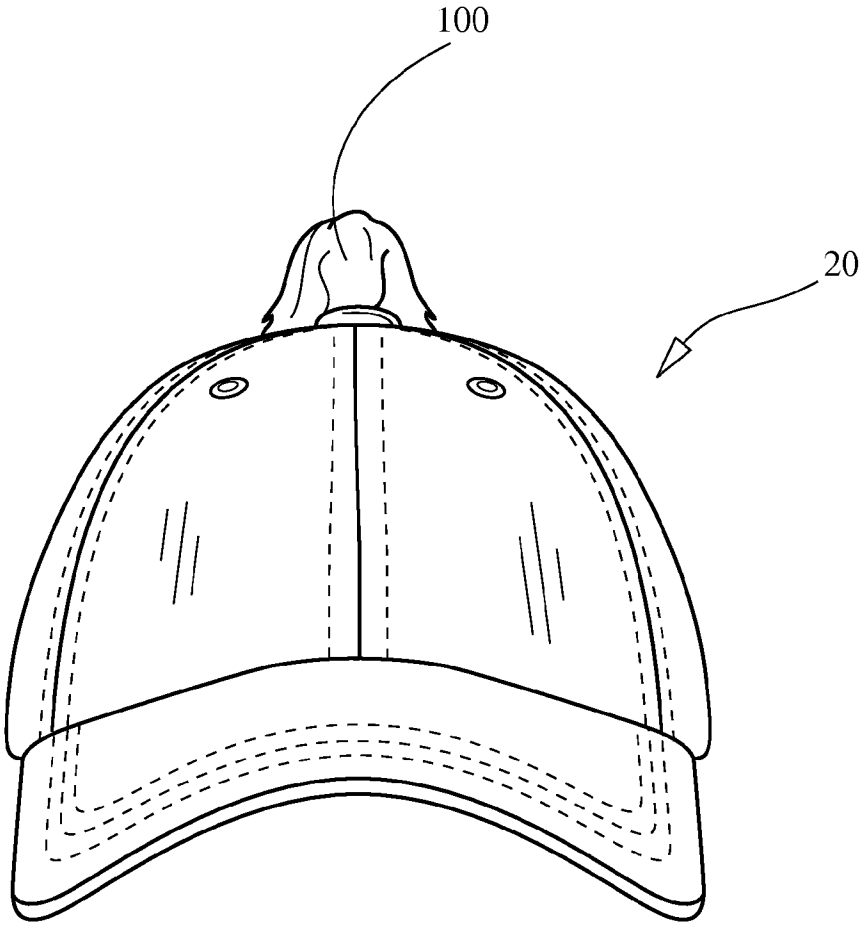
FIG. 14 is a front view of the hat of FIG. 9.
Figure 15:
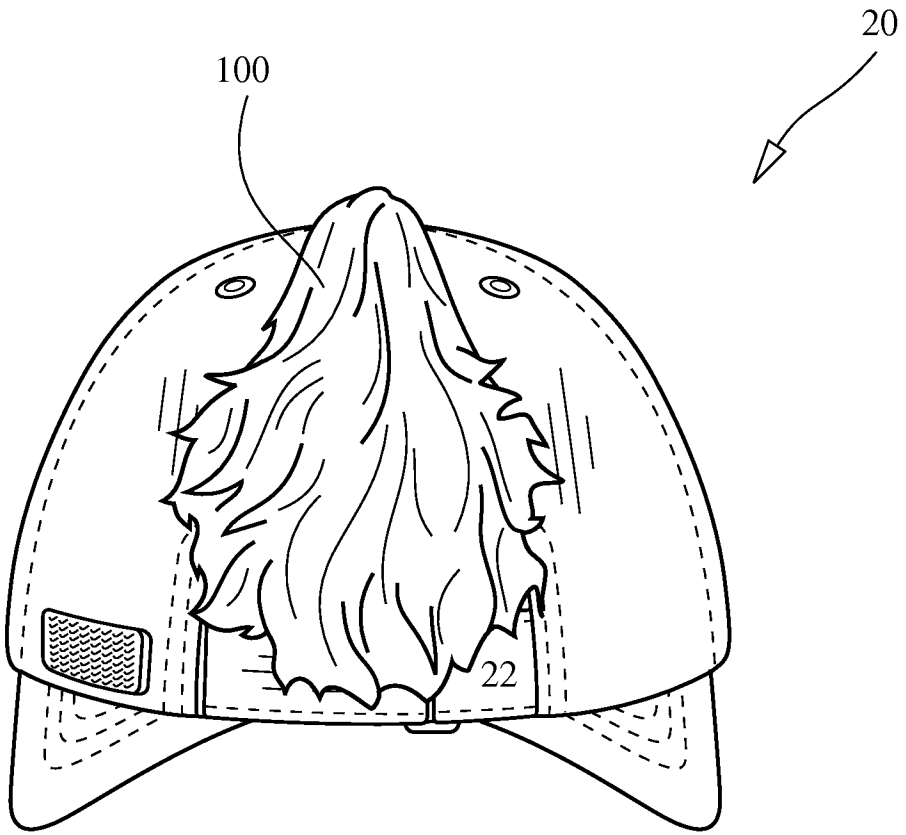
FIG. 15 is a back view of the hat of FIG. 9.
Figure 16:
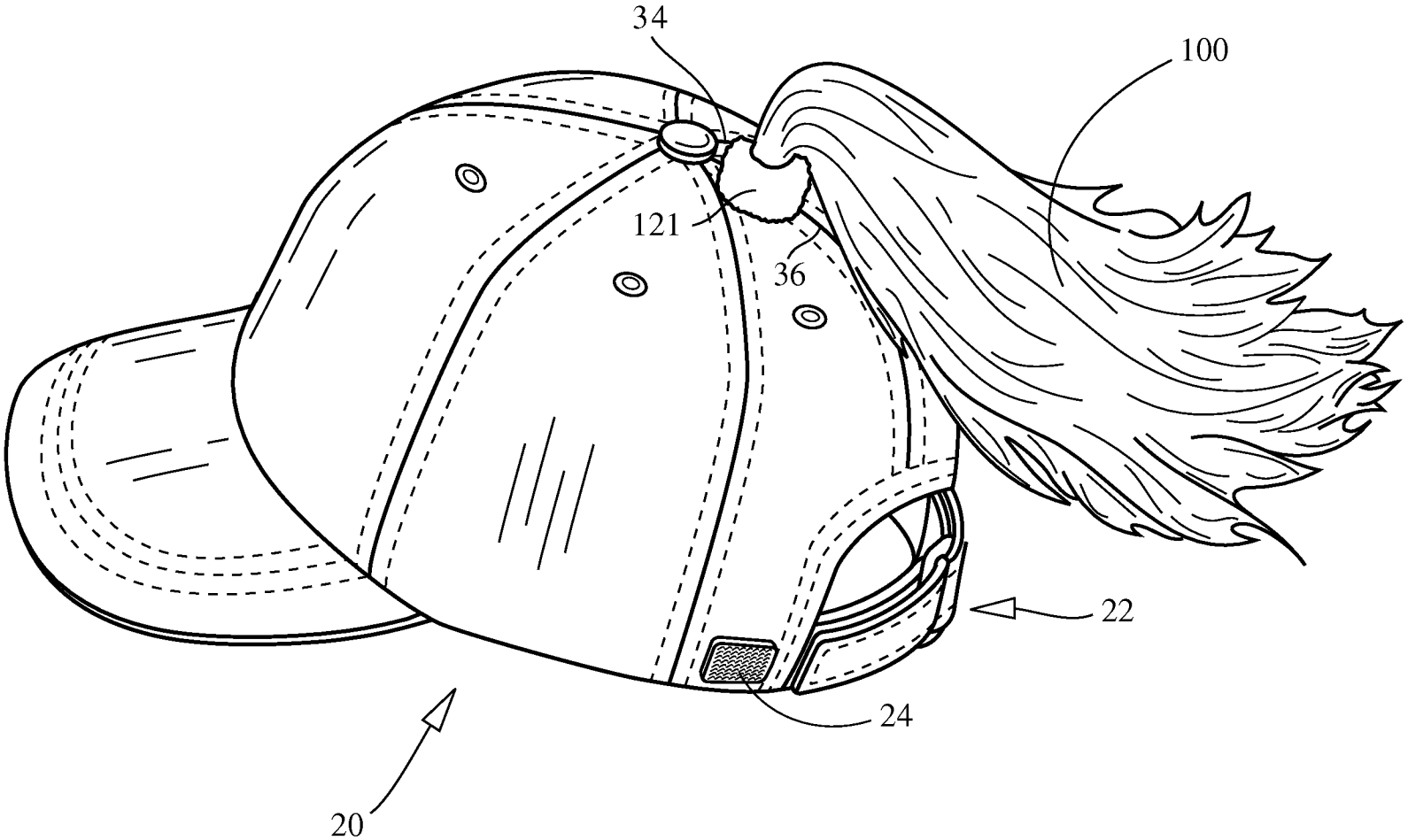
FIG. 16 is a back perspective view of the hat of FIG. 9.
Figure 17:
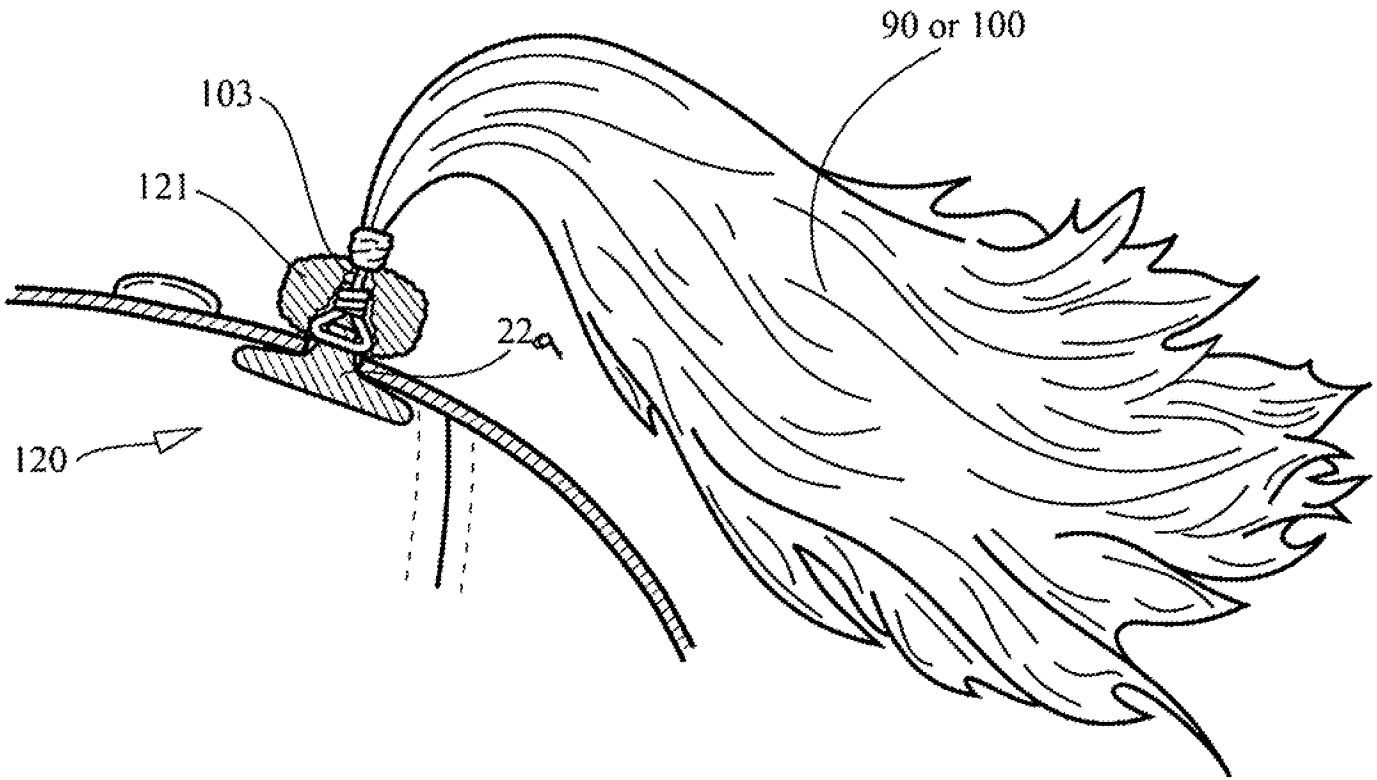
FIG. 17 is an partial sectional view showing one non-limiting embodiment for the securement of a synthetic hair portion to the hat in accordance with the present invention.
Figure 18:
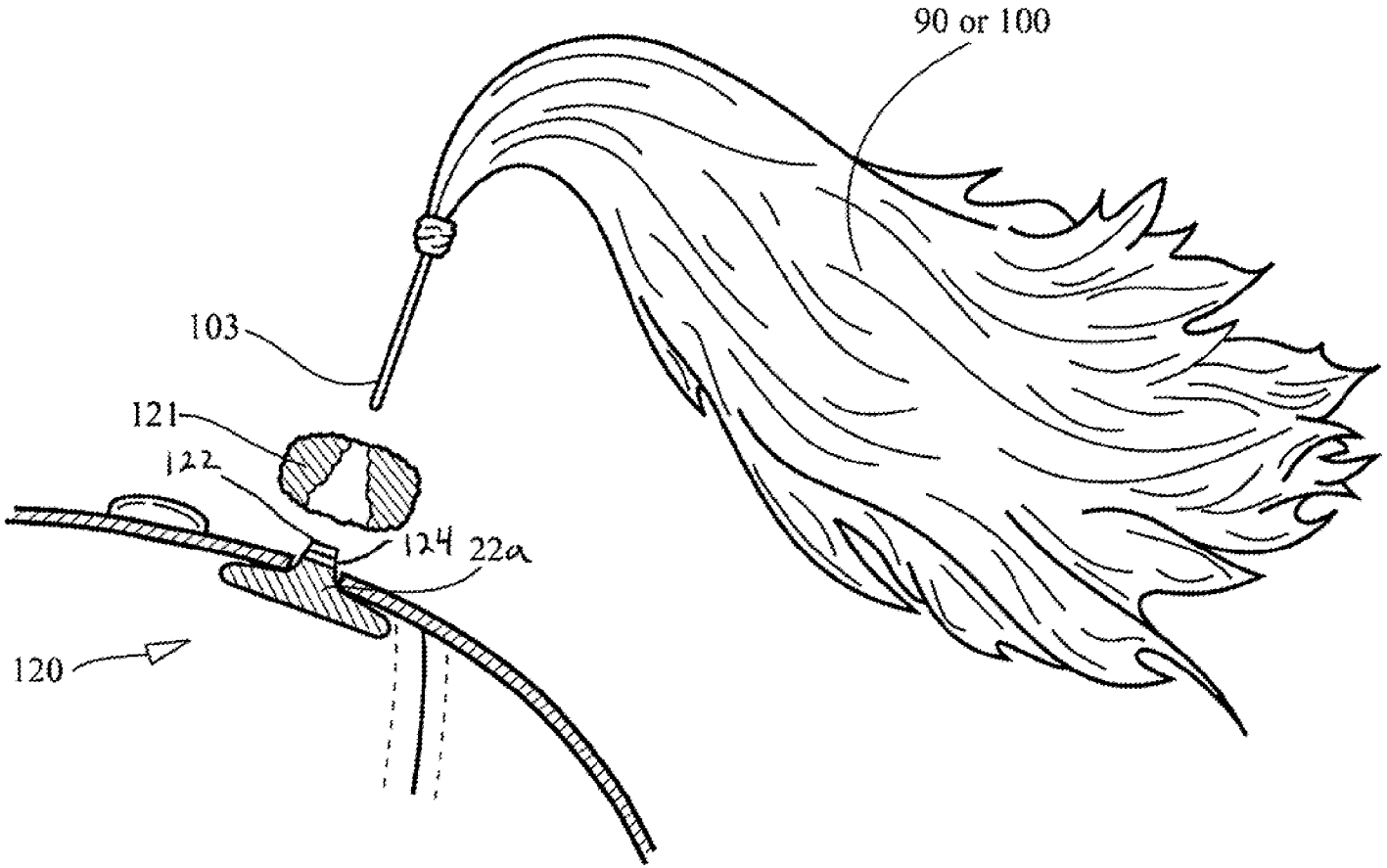
FIG. 18 is an exploded view of the non-limiting securement embodiment of FIG. 17.

Below the steps involved in creating hat 20 with one or more pigtails 90 or ponytail 100 will be described, though the same securement techniques can be used for other hair style forms. In one non-limiting embodiment, hat 20 can be a conventional baseball cap such as, but not limited to, a six panel cotton baseball cap. A closure and/or adjustment mechanism, such as, but not limited to a hook and loop fastening closure mechanism 22 can be preferably provided at the back of the hat 20. As best seen in FIG. 6, one or more additional pieces of hook and loop fastening material 24 can be provided on a lower back edge of hat 20 near closure mechanism 22, to provide additional area for adjusting the size of hat 20, such as a for smaller head sizes. Though not considered limiting, preferably the additional material 24 corresponds to the color of hat 20 where it is secured, such that additional material is not significantly noticeable when hat 20 is worn. Additional material 24 is not limited to any particular shape and can be en elongated strip, one or more square or circular members, etc. and variations can be used and are considered within the scope of the invention. Preferably, though again not limiting, additional material 24 is added about or approximately ¾" from conventional closure mechanism 22. It is also within the scope of the invention that hat 20 not have any adjustment mechanism at the back of the hat.

Though not required an identification tag, identifying the manufacturer, distributor, seller, etc. of the present invention and providing contact information can be iron on, sewn into, or otherwise secured within the inside of hat 20. Though also not required, a template can be preferably used for marking where to cut the holes in baseball cap 20 where the pig tails 90 or pony tails 100 will protrude out from or be secured to, in order to provide consistency from one cap 20 to the next. Preferably, the holes 31 are generated or created on the seam lines 30 between the panels 28. Where pig tails 90 are to be provided with hat 20 two holes are preferably created through hat 20, by conventional means, one hole on angled back seam 32 and a correspondingly spaced second hole on angled back seam 34. Where pony tail 100 is to be provided, a single hole on straight back reinforcement strip 36 is preferably created through hat 20 by conventional means. The holes are provided on one or more seams or reinforcements in order to insert the top section (i.e. mushroom like shape, etc.) of a conventional suction cup therethrough. Though different sizes of suction cups can be used and are considered within the scope of the invention, when providing pony tail 100, preferably a single 1 13/16" in diameter suction cup is provided and when providing pigtails 90, preferably two 1¼" in diameter suction cups are provided, one for each hole. Accordingly, it is preferred, though not limiting, that the holes created for the suctions cups are not any of the preexisting holes normally provided on the baseball cap or hat 20, and thus the holes are created solely for the purpose of securing the synthetic hair preferably in the form of a single pony tail 100 or a pair of pigtails 90.

A hole 124 can be preferably created through the mushroom-like shape knob 122 (i.e. top portion) of the suction cup 120 and preferably goes from side to side of knob 122, as opposed to down the center of knob 122. The knob or top portion 122 of suction cup 120 can be preferably inserted through a specifically created hole 22*a* (and preferably not a pre-existing hole) in hat 20. Thus, top portion 122 is extending through hat 20 and the bottom portion 126 of suction cup 120 remains within the head receiving area of hat 20.

For preferably securing either pigtail 90 or ponytail 100 to knob 122, a wire 103 or similar member can be provided at the securement end of synthetic hair portion that will be used as pigtail 90 or ponytail 100. For a ponytail 100 approximately double the amount of synthetic hair can be preferably used as compared to a pigtail 90. When securing, wire 103 is inserted through hole 124 in knob 122 and then wire 103 can be preferably bent or wrapped around knob 122.

Additionally, where it is desired to have a large amount of synthetic hair freely hanging down and covering a large amount of the hat area two suction cups can be provided similar to the pigtail 90 embodiment, but used to secure each end of the large amount of freely hanging synthetic hair.

It should be understood and recognized that other securement mechanism can be used and are considered within the scope of the invention. Certain securement mechanisms may also eliminate the need to create holes in hat 20, and the securement can be also entirely at the outer surface of hat 20.

Regardless of securement method used, hair bands 121 can be disposed on the outer surface of hat 20 at the point where pigtail 90 or ponytail 100 is secured to hat 20 to hide the securement mechanism (i.e. hides wire 103 and knob 122, etc.). Hair bands 121 also hold the strands of synthetic hair comprising pigtail 90 or ponytail 100 as they would normally hold actual live human hair being worn in pigtail 90 or ponytail 100 by a person.

With hair band 121 in place, preferably the created hole for inserting top portion 122 of suction cup 120 therethrough is sewn closed, as well as sewing hair band 121 to hat 20. Other securement and closing methods can be used. However, the hole is closed and hair band 121 is secured to hat 20 to prevent the various components from coming apart.

A covering, such as a fleece covering, can be provided over the suction cup bottom and preferably secured to the inner surface of hat 20. Covering 127 can be sewn to form a pocket preferably slightly larger than the suction cup 120 to which it will cover. Preferably, the thread of the covering can be pulled tight and knotted and then glued to the inside surface of hat 20.

Though not considered limiting, it is preferred that pigtail 90, pony tail 100 or any other secured synthetic hair portions (i.e. freely hanging, etc.) remain permanently secured to hat 20.

Though it is preferred to create the one or more holes in hat 20 within the seams or reinforcements of hat 20, it is also within the scope of the invention to create the holes in other locations on hat 20 or even to use a pre-existing hole, if any, in hat 20, Additionally, other hat 20s may not have seams or their seams may be at undesirable locations on hat 20, and thus again, the holes can be created on non-seam areas on hat 20.

Other decorative elements, logos, wording, etc. can be secured to or disposed on the outside of hat 20 as is conventionally known.

All locations, sizes, measurements, amounts, weights, dimensions, values, percentages, materials, orientations, etc. discussed above or shown in the drawing figures are merely by way of example and are not considered limiting and other locations, sizes, measurements, amounts, weights, dimensions, values, percentages, materials, orientations etc. can be chosen and used and all are considered within the scope of the invention.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A combination headwear and synthetic hair portion having the appearance of live human hair, said combination comprising:

a hat having an outer surface and an inner surface;

at least one synthetic hair portion having the appearance of human hair, each of said at least one synthetic hair portion comprising multiple strands of synthetic hair held together;

wherein said at least one synthetic hair portion comprises a single ponytail;

wherein a first hole is disposed through said hat at a back half portion of said hat and said combination further comprising a first suction cup having a top portion and bottom portion, wherein said top portion is inserted through said first hole and the bottom portion remaining within a head receiving area of said hat; wherein said synthetic hair portion is secured to said top portion of said first suction cup.

2. The combination headwear and synthetic hair portion of claim 1 wherein said hat is a multiple panel hat having a straight back seam and said single ponytail secured to said hat through a portion of said straight back seam.

3. The combination headwear and synthetic hair portion of claim 1 further comprising a hair band disposed around a portion of said synthetic hair portion and hiding a securement point of said synthetic hair portion to said top portion of said first suction cup.

4. The combination head eat and synthetic hair portion of claim 1 further comprising a hat size adjustment member permanently attached to a portion of a back outer surface of the hat, said hat size adjustment having a hook and loop fastening member where it can mate with a hook and loop fastening member of a strap member provided as part of an head size adjustment mechanism for the hat, said hat size adjustment member is secured to a side of a back opening or cutout of said hat and is not disposed within the back opening or cutout.

5. The combination headwear and synthetic hair portion of claim 1 wherein said hat is of a baseball cap style.

6. The combination headwear and synthetic hair portion of claim 3 wherein said hair band is permanently secured to the hat.

7. The combination headwear and synthetic hair portion of claim 3 wherein said synthetic hair portion is permanently secured to said hat.

8. A combination headwear and synthetic hair portion having the appearance of live human hair, said combination comprising:

a hat having an outer surface and an inner surface;

at least one synthetic hair portion having the appearance of human hair, each of said at least one synthetic hair portion comprising multiple strands of synthetic hair held together;

wherein said at least one synthetic hair portion comprises in a pair of pig tails;

wherein a first hole is disposed through said hat at a first back portion of said hat and a second hole is disposed through said hat at a second back portion of said hat; wherein said combination further comprising a first suction cup having, a top portion and a bottom portion and a second suction cup having a top portion and a bottom portion; wherein said top portion of said first suction cup is inserted through said first hole and the bottom portion of said first suction cup remaining within a head receiving area of said hat and said top portion of said second suction cup is inserted through said second hole and the bottom portion of said second suction cup remaining within the head receiving area of said hat; wherein a first synthetic hair pigtail of the pair of pigtails is secured to said top portion of said first suction cup and a second synthetic hair pigtail of the pair of pigtails is secured to said top portion of said second suction cup.

9. The combination headwear and synthetic hair portion of claim 8 further comprising a first hair band disposed around a portion of said first synthetic hair pigtail and hiding a securement point of said first synthetic hair pigtail to said top portion of said first suction cup and a second hair band disposed around a portion of said second synthetic hair pigtail and hiding a securement point of said second synthetic hair pigtail, to said top portion of said second suction cup.

10. The combination headwear and synthetic hair portion of claim 8 wherein said hat is a multiple panel hat having a first angled back seam and a second angled hack seam and a first of said pair of pig tails secured to said hat at a portion of said first angled back seam and a second of said pair of pig tails secured to said hat at a portion of said second angled back seam.

11. The combination headwear and synthetic hair portion of claim 9 wherein said first hair band and said second hair band are permanently secured to said hat.

12. The combination headwear and synthetic hair portion of claim 9 wherein said first synthetic hair pigtail and said second synthetic hair pigtail are permanently secured to said hat.

13. A combination headwear and synthetic hair portion having the appearance of live human hair, said combination comprising:

a multiple panel, baseball style hat having an outer surface and an inner surface and a first angled back seam and a second angled back seam said hat having a first hole disposed within a portion of said first angled back seam and a second hole disposed within a portion of said second angled back seam, wherein said first hole and said second hole are spaced from a center of the hat at substantially a same distance;

a first synthetic hair portion comprising multiple strands of synthetic hair held together and having the appearance of a first human hair pigtail;

a second synthetic hair portion comprising multiple strands of synthetic hair held together and haying the appearance of a second human hair pigtail;

a first suction cup having a top portion and a bottom portion, said top portion of said first suction cup inserted through said first hole and the bottom portion of said first suction cup remaining within a head receiving area of said hat, said first synthetic hair portion secured to said top portion of said first suction cup;

a second suction cup having a top portion and a bottom portion, said top portion of said second suction cup inserted through said second hole and the bottom portion of said second suction cup remaining within the head receiving area of said hat, a second synthetic hair portion secured to said top portion of said second suction cup;

a first hair band disposed around a portion of said first synthetic hair portion and hiding a securement point of said first synthetic hair portion to said top portion of said first suction cup; and a second hair band disposed around a portion of said second synthetic hair portion and hiding a securement point of said second synthetic hair portion to said top portion of said second suction cup.

14. The combination headwear and synthetic hair portion of claim 13 wherein said first hair band and said second hair band are permanently secured to said hat.

15. The combination headwear and synthetic hair portion of claim 13 wherein said first synthetic hair portion and said second synthetic hair portion are permanently secured to said hat.

16. A combination headwear and synthetic hair portion having the appearance of live human hair, said combination comprising:

a multiple panel baseball style hat having an outer surface and an inner surface and a straight back seam, said hat having a hole disposed within a portion of said straight back seam, wherein said hole is spaced away from a center of the hat;

a synthetic hair portion comprising multiple strands of synthetic hair held together and having the appearance of a human hair ponytail;

a suction cup having a top portion and a bottom portion, said top portion of said suction cup inserted through said hole and the bottom portion of said suction cup remaining within a head receiving area of said hat, said synthetic hair portion secured to said top portion of said suction cup; and a hair band disposed around a portion of said synthetic hair portion and hiding a securement point of said synthetic hair portion to said top portion of said suction cup.

17. The combination head wear and synthetic hair portion of claim 16 wherein said hair band is permanently secured to the hat.

18. The combination headwear and synthetic hair portion of claim 16 wherein said synthetic hair portion is permanently secured to said hat.

* * * * *

UNITED STATES PATENT AND TRADEMARK OFFICE

CERTIFICATE OF CORRECTION

PATENT NO. : 8,418,266 B1
APPLICATION NO. : 12/827766
DATED : April 16, 2013
INVENTOR(S) : Patricia Pike It is certified that error appears in the above-identified patent and that said Letters Patent is hereby corrected as shown below:

In the Claims:

Column 4, line 65, “head eat” should read --headwear--

Signed and Sealed this
Sixteenth Day of July, 2013

Teresa Stanek Rea
*Acting Director of the United States Patent and Trademark Office*